US012044076B2

(12) United States Patent
Henderson et al.

(10) Patent No.: US 12,044,076 B2
(45) Date of Patent: Jul. 23, 2024

(54) MECHANICALLY ACTUATED TUBULAR DRILLING, REAMING AND RUNNING TOOL WITH SLIP SET CONTROL

(71) Applicant: PREMIERE, INC., Houston, TX (US)

(72) Inventors: Kris Henderson, Houston, TX (US); Jayaram Subramanian, Houston, TX (US)

(73) Assignee: PREMIERE, INC., Houston, TX (US)

( * ) Notice: Subject to any disclaimer, the term of this patent is extended or adjusted under 35 U.S.C. 154(b) by 0 days.

(21) Appl. No.: 17/340,012

(22) Filed: Jun. 5, 2021

(65) Prior Publication Data

US 2021/0381320 A1 Dec. 9, 2021

Related U.S. Application Data

(60) Provisional application No. 63/035,424, filed on Jun. 5, 2020.

(51) Int. Cl.
*E21B 17/043* (2006.01)
*E21B 4/18* (2006.01)
*E21B 17/02* (2006.01)

(52) U.S. Cl.
CPC ..... *E21B 17/021* (2013.01); *E21B 4/18* (2013.01); *E21B 17/043* (2013.01)

(58) Field of Classification Search
CPC ..... E21B 17/042; E21B 19/07
See application file for complete search history.

(56) References Cited

U.S. PATENT DOCUMENTS

| | | | | |
|---|---|---|---|---|
| 3,131,586 | A * | 5/1964 | John | E21B 19/16 81/473 |
| 4,084,429 | A * | 4/1978 | Boland | E21B 19/16 73/773 |
| 5,048,612 | A * | 9/1991 | Cochran | E21B 23/01 166/216 |
| 6,845,826 | B1 * | 1/2005 | Feld | E21B 4/006 175/320 |
| 9,416,601 | B2 * | 8/2016 | Mullins | E21B 19/06 |
| 10,626,683 | B2 * | 4/2020 | Hebebrand | E21B 19/14 |
| 2009/0321086 | A1 * | 12/2009 | Zimmermann | E21B 19/07 166/98 |
| 2014/0151067 | A1 * | 6/2014 | Hart | E21B 43/10 166/85.1 |
| 2015/0107385 | A1 * | 4/2015 | Mullins | E21B 19/06 74/25 |
| 2020/0347683 | A1 * | 11/2020 | Hickl | E21B 19/10 |

* cited by examiner

*Primary Examiner* — Shane Bomar
(74) *Attorney, Agent, or Firm* — Quisenberry Law PLLC

(57) ABSTRACT

An apparatus for transferring torque comprising a pipe handling assembly configured to use fluid pressure to provide torque forces to set or release slips from a pipe. Set down force or other frictional measures on a pipe collar are not required. A method to create reactive torque force comprising a series of gears interconnected with each other through a clutch that can be engaged and disengaged. A link may be provided to a top drive rail via a gripperbox which provides reactive force to stop rotation of a power screw female (threaded nut) to facilitate threading action to set or release slips on pipe. Reactive force may be created using a plurality of axial pistons attached to a moveable half of a hirth coupling. Other friction-creating members (such as, for example, a brake pad material or similar material) may be used to create frictional forces between two surfaces.

24 Claims, 11 Drawing Sheets

MECHANICALLY ACTUATED TUBULAR DRILLING, REAMING AND RUNNING TOOL WITH SLIP SET CONTROL

RELATED APPLICATIONS

This application claims the benefit of U.S. Provisional Application No. 63/035,424, filed Jun. 5, 2020, the contents of which are fully incorporated herein by reference.

BACKGROUND OF THE INVENTIONS

Tubular drilling, reaming and running tools are mechanisms used in well bore completion services and are used to grip, rotate and reciprocate sections of tubular or an entire string of tubulars installed in an oil and gas wellbore. The engagement, dis-engagement and operation of tubular(s) can be performed mechanically using the power provided by the top drive or by using an external source of energy.

Conventional mechanically activated tubular drilling, reaming and running tools require a torsional reaction against the tubular to operate, engage or disengage the tool. Typically, the "bumper plate" is designed to engage the exposed face of the tubular and requires a compressive load at this interface. The friction component of this compressive load provides said torsional resistance. The ability or lack thereof for these types of tubular drilling, reaming, and running tools to develop adequate torsional resistance consistently, is dependent on many factors including set-down load, friction enhancing components, materials and inner springs.

The exposed face of the tubular is usually the female half of a threaded connection, sometimes referred to as a coupling. Depending on the frictional resistance between the coupling face and the tool has proven to be problematic because a considerably small surface area of the tubular face implies a great and sometimes dangerous set-down force required to generate adequate torsional resistance. This can cause severe damage to the tubular connection and therefore cause catastrophic failure including loss of life and possible loss of control of the well.

Thus, there is a need for a mechanically activated tool that is not dependent on this set down force or the frictional characteristics on the tubular connection.

SUMMARY OF THE INVENTIONS

In a preferred embodiment, the present inventions rely on fluid pressure to provide an alternative means to facilitate the torque reaction required to set or release slips from a pipe and eliminate the need for set down force or other frictional measures on a tubular.

One method utilized to create this reaction force relies on a series of gears interconnected with each other through a fluid driven clutch that can be engaged and disengaged. The hold back torque generated through the clutch driven system when coupled to a power screw female (threaded nut), can convert the rotational motion of the top drive to axial motion of the slips facilitating the tool to grip or release the tubular.

Another technique to create the reactionary force is to utilize a series of axial pistons attached to the moveable half of a hirth coupling, or other friction member, e.g. brake pad material or similar material used to create frictional forces between two surfaces sufficient to transfer torque. In the current inventions the preferred method is a hirth coupling. However, this is not the only device that can be used.

Shifting the torsional reaction from tool-tubular interface to the top drive-tubular running tool interface eliminates potential damage to the critical threads of both the pin and receiving female threads of the tubular.

Both methods of the current inventions provide the reaction force (torque) from the rig's top drive system. This eliminates the need to rely on the friction created between the female end of the tubular and tool.

It will be evident with the inventions that little to no set down weight on the tubular is needed to facilitate setting or releasing the slips. The first embodiment of the current inventions utilizes a power screw (male thread) and nut (female thread). The female thread is kept from rotating via a series of gears and a fluid operated clutch. The gear arrangement delivers a multiplication effect to the torque output of the clutch.

The clutch essentially acts as a holding brake to the female thread until the desired torque and thereby the set force on the tubular is reached. The driller can engage the clutch from the driller's cabin and re-engage at any time in case the slips need to reset on the pipe.

The clutch/gearbox assembly can achieve the reaction torque from several static components on a rig, the top drive or the bails being one such example and can be activated via fluid (hydraulic or pneumatic) or electronic activation.

Other features, aspects and advantages of the present inventions will become apparent from the following discussion and detailed description.

BRIEF DESCRIPTION OF THE DRAWINGS

The foregoing summary, as well as any detailed description of the preferred embodiments, is better understood when read in conjunction with the drawings and figures contained herein. To illustrate the inventions, the drawings and figures show certain preferred embodiments. It is understood, however, that the inventions are not limited to the specific methods and devices disclosed in such drawings or figures. Further, any depicted dimensions or material selections are illustrative only and are not intended to be, and should not be construed as, limiting in any way.

Figure 1:
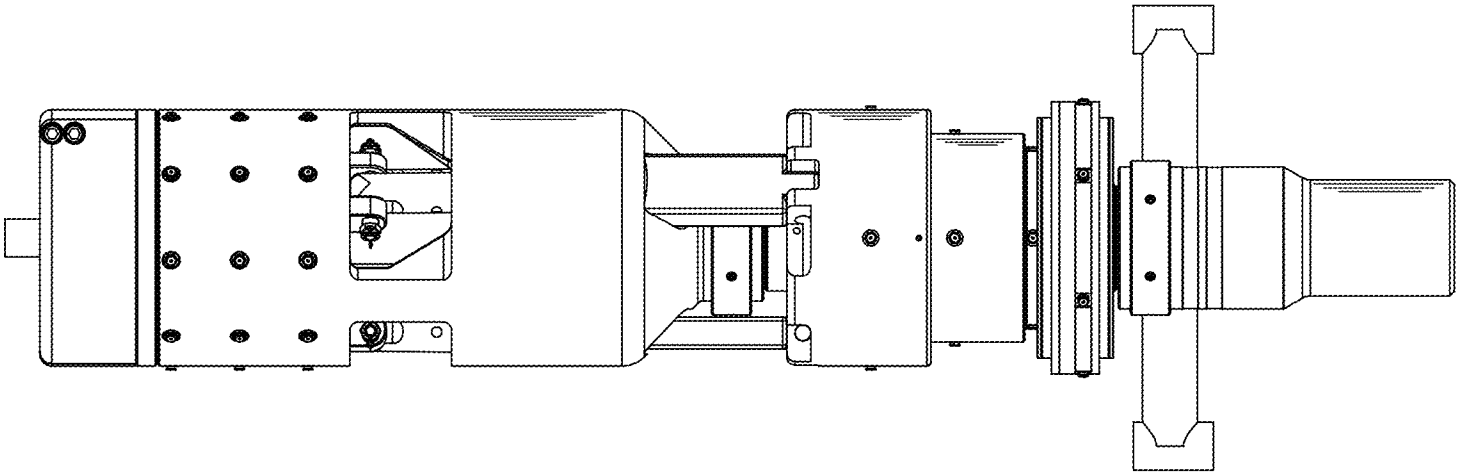
FIG. 1 depicts the current inventions configured as an external tubular drilling, reaming, and running tool.
Figure 2:
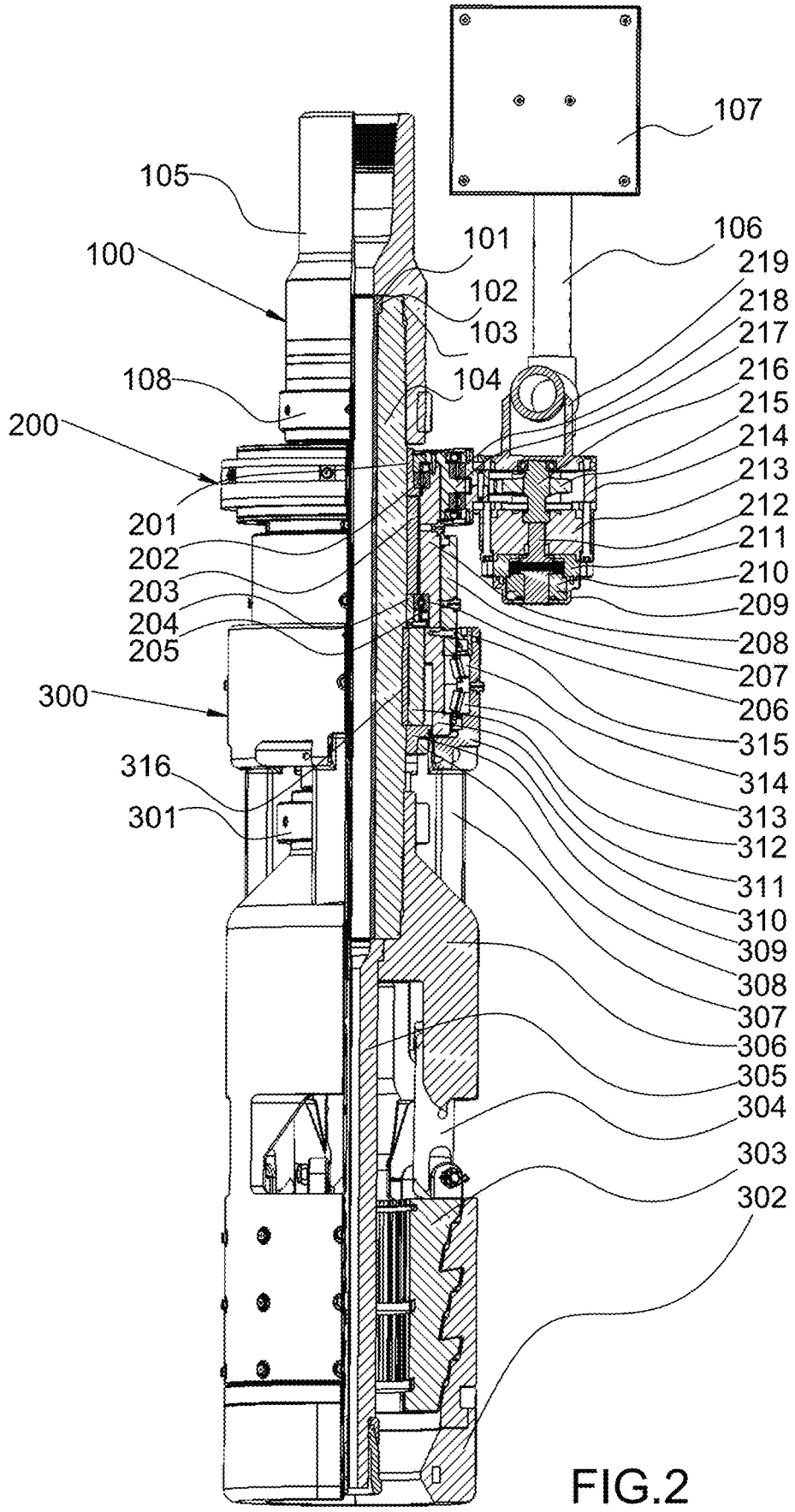
FIG. 2 depicts a partial cutaway view of the current inventions.

Reference numbers depicted in the attached drawings correspond to the following components:

100 Main Tool Body—Tool body of the current invention.

101 Through Bore Liner—The liner protects the main tool body from corrosive mud.
102 O-ring—Seals the mud from the tool body.
103 O-ring—Seals the mud from the tool body.
104 Main Tool Shaft—Transmits axial loads and radial torque to the tubular.
105 Crossover—Upper most threaded connection that threads into the top drive's quill.
106 Gripper Arm—Upper arm that provides a torque arm to counteract torsional load on the power screw nut.
107 Gripper Pad—Located on either side of the gripper box and provides interface between the tool and gripper box.
108 Block Lock Retaining Ring—Locks the crossover to the main tool shaft and transmits torque.
200 Gear/Clutch Assembly—Provides rotational hold back torque to create an axial force.
201 Upper Split Load Ring—Supports the upper main bearing.
202 Upper Main Bearing—Upper main bearing for ring gear sleeve.
203 Bearing Spacer—Spacer to separate the upper and lower bearings.
204 Lower Split Load Ring—Supports lower main bearing.
205 Load Ring Retainer—Retains the lower split ring.
206 Lower Main Bearing—Supports the ring gear sleeve.
207 Female Spline Ring—Transmits radial torque while moving axially through the tool's stroke.
208 Ring Gear Sleeve—Transmits the torque going through the ring gear to the lower end of the tool.
209 Clutch Cover—Serves as static anchor to help the transfer of torque.
210 Clutch Assembly—The normal mode for the clutch is release mode; during tool setting, the clutch is activated to a set amount of pressure that will slip if excess amount of torque is sensed.
211 Clutch Mount—Aids clutch cover in serving as static anchor.
212 Planetary/Clutch Shaft—Couples the planetary and clutch while transferring the holding torque through the clutch/planetary gear drive to the ring gear
213 Planetary Gear Drive—Multiplies the amount of holding torque in a small package.
214 Spacer Housing—Provides the necessary space required to house the gearing.
215 Pinion Gear—Transmits the holding torque applied through the clutch/planetary to the ring gear.
216 Pinion Gear Shaft—Ties the output of the planetary through the pinion gear to an outboard bearing.
217 Ring Gear—Prevents rotation of the tool, multiplied through the pinion and planetary gearing.
218 Main Gear Bearing—Supports the main ring gear.
219 Gripper Arm Socket—Provides a socket for two gripper arms to be mounted.
220 Idler Gear—Transfers torque from ring gear to the pinion gear
300 Bowl/Slip Assembly—Transmits torque and axial load through to the bowl/slip assembly.
301 Block Lock Retaining Ring—Locks the bowl to the main shaft assembly and transmits rotary torque.
302 Pipe Guide—Guides the pipe into the bowl centralizing the pipe.
303 Slips—Grips the pipe and transmits torque and axial tension through the bowl.
304 Secondary Slip Push Bar—Connects the slip and the main push bar to the push plate.
305 Stinger—Provides a sealed tube to inject mud into the casing.
306 Slip Bowl—Provides for axial support and transfers torque through the slips and top drive.
307 Main Slip Push Bar—Connects the push plate to the secondary slip push bar to the slips.
308 Split Ring Retainer—Retains the split ring retainer in place.
309 Power Screw Split Ring—Provides support for the power screw male thread.
310 Push Plate—Converts the top drives radial movement to an axial force via the tool body.
311 Power Screw Female Thread—Rides the male threads to convert rotational motion to axial motion.
312 Power Screw Male Thread—Transmits rotary torque converting to axial force.
313 Push Plate Lower Bearing—A tapered roller bearing which transmits rotary movement to axial movement.
314 Push Plate Upper Bearing—A tapered roller bearing which transmits rotary movement to axial movement.
315 Seal Cap—Protects the seal from outside contaminants.
316 Torque Key—Transmits from the main shaft to the male power screw thread.
400 Hirth Mechanically Actuated Tool
401 Anti-rotation Deck
402 Upper Bearing Assembly
403 Lower Fixed Hirth Coupling
404 Lower Bearing
405 Trunnion Slot
406 Female Power Screw Thread
407 Male Power Screw Thread
408 Torque Key
409 Slip Push Plate Carrier
410 Slip Push Plate
411 Push Plate Bearing Assembly
412 Slip Push Bars
413 Slip Dies
414 Lower Mandrel
415 Main Tool Body
416 Bumper Plate
500 Fluid Axial Piston Assembly
501 Static Seal Ring
502 Torque Pin
503 Spring Retaining Bolt
504 Return Spring
505 Fluid Piston
506 Fluid Port
507 Movable Hirth Coupling Half
508 Air Breather Port
509 Fluid Supply Galley
510 Static O-ring Seals While the inventions will be described in connection with the preferred embodiments, it will be understood that the scope of protection is not intended to limit the inventions to those embodiments. On the contrary, the scope of protection is intended to cover all alternatives, modifications, and equivalents as may be included within the spirit and scope of the inventions as defined by the appended claims.

DETAILED DESCRIPTION OF THE INVENTIONS

In the drawings, certain features well established in the graphics are omitted in the interest of descriptive clarity. Such features may include weld lines, threaded fasteners, surface finishes, etc.

Figure 3:
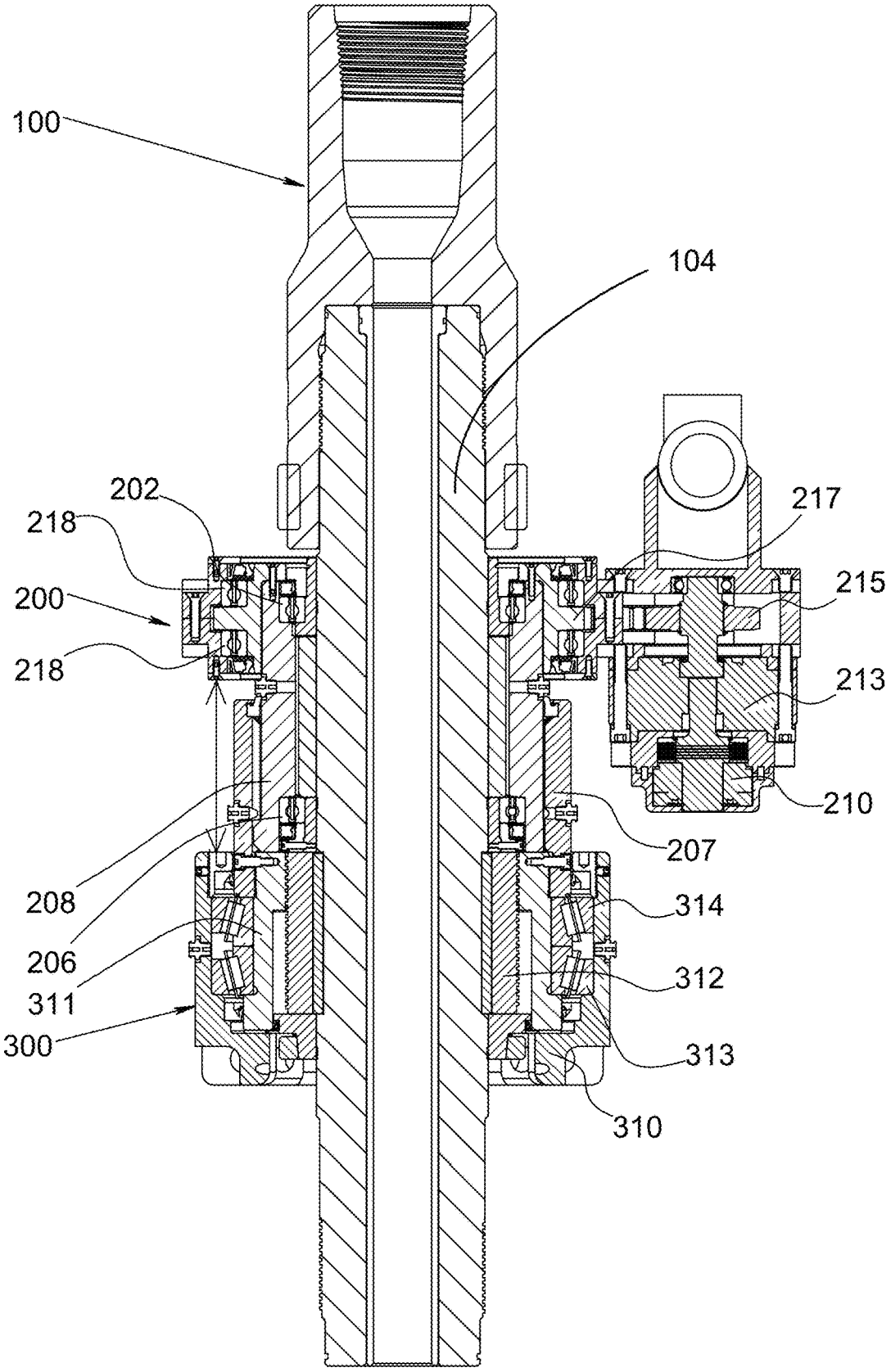
FIG. 3 depicts a specific embodiment of an actuator assembly of the present inventions in a released mode.
Figure 6:
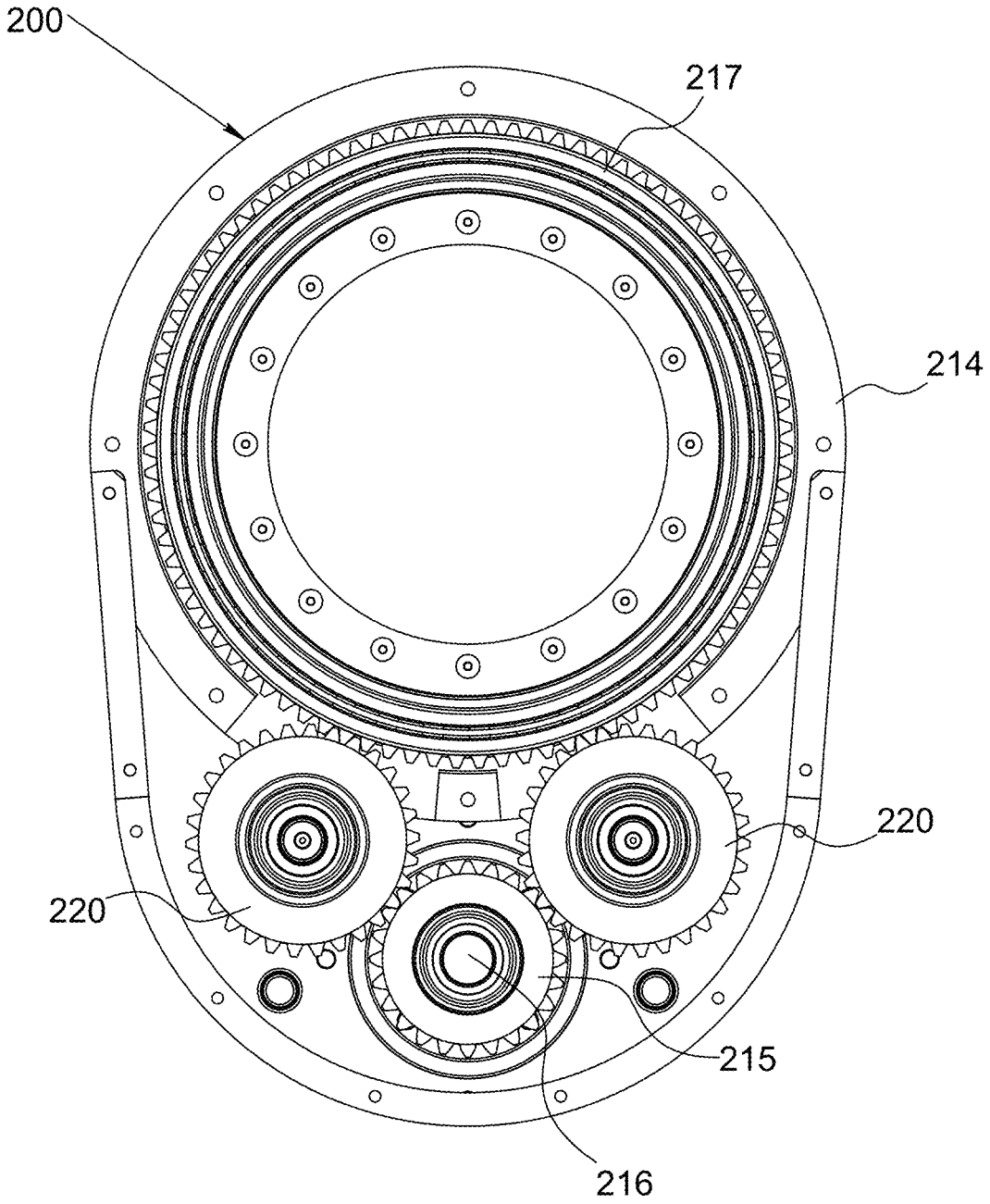
FIG. 6 depicts a gearbox assembly that multiplies the clutch's torque holding capability.

FIG. 3 shows a specific embodiment of the current inventions in the released mode. If the tool is in the set mode and the driller wants to release the tool from the tubular, he first needs to stop rotation and set the spider. Pressure (air or hydraulic) then is applied to clutch assembly 210. Once pressure has been applied, the torque is multiplied by planetary gear drive 213, pinion gear 215 and ring gear 217 causing ring gear 217 to be held to a specific torque value. This gear train mechanism is shown in FIG. 6.

Figure 7:
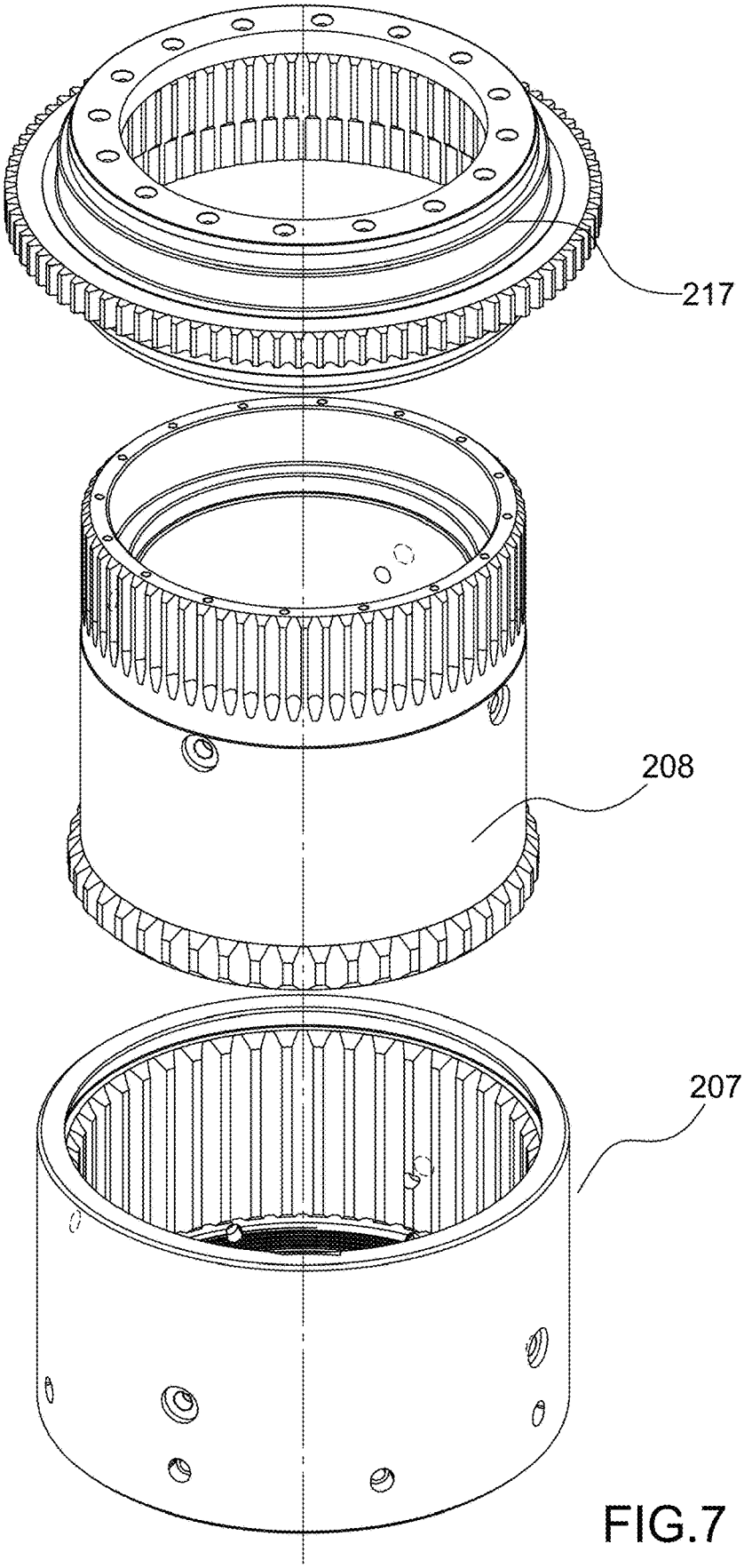
FIG. 7 depicts the ring gear/sleeve assembly of the present inventions.
Figure 8:
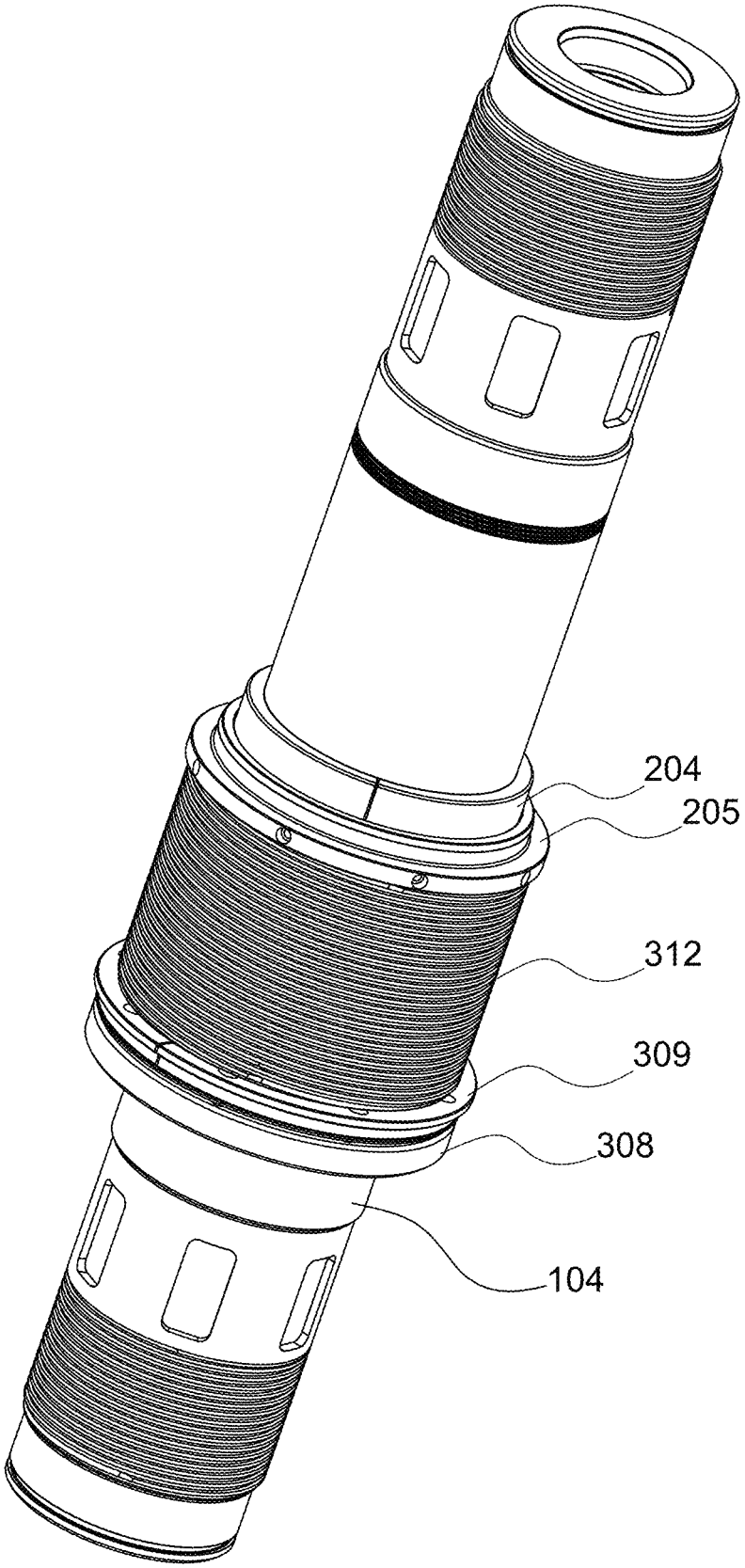
FIG. 8 depicts the main shaft assembly of the present inventions with male power thread visible.

FIG. 7 shows the transmission of torque through ring gear sleeve 208 onto female spline ring 207. The female spline 207 is rigidly attached to power screw female 311.

Once the clutch is engaged, the top drive can now turn counterclockwise in order to release the slips. Once the top drive turns counterclockwise, the power screw male 312 turns with the tool body 104 through the torque key(s) 316. This torque is translated into axial force through the power screw female 311. Push plate 310 does not rotate due to engagement with push plate bearings 313 and 314 while the top drive rotates.

Pressure on clutch assembly 210 must be present the entire time the tool is releasing or setting in order for the tool to deliver the holding torque required to the power screw female 311. When the tool is in operation, clutch assembly 210 is released and freely rotates.

Figure 4:
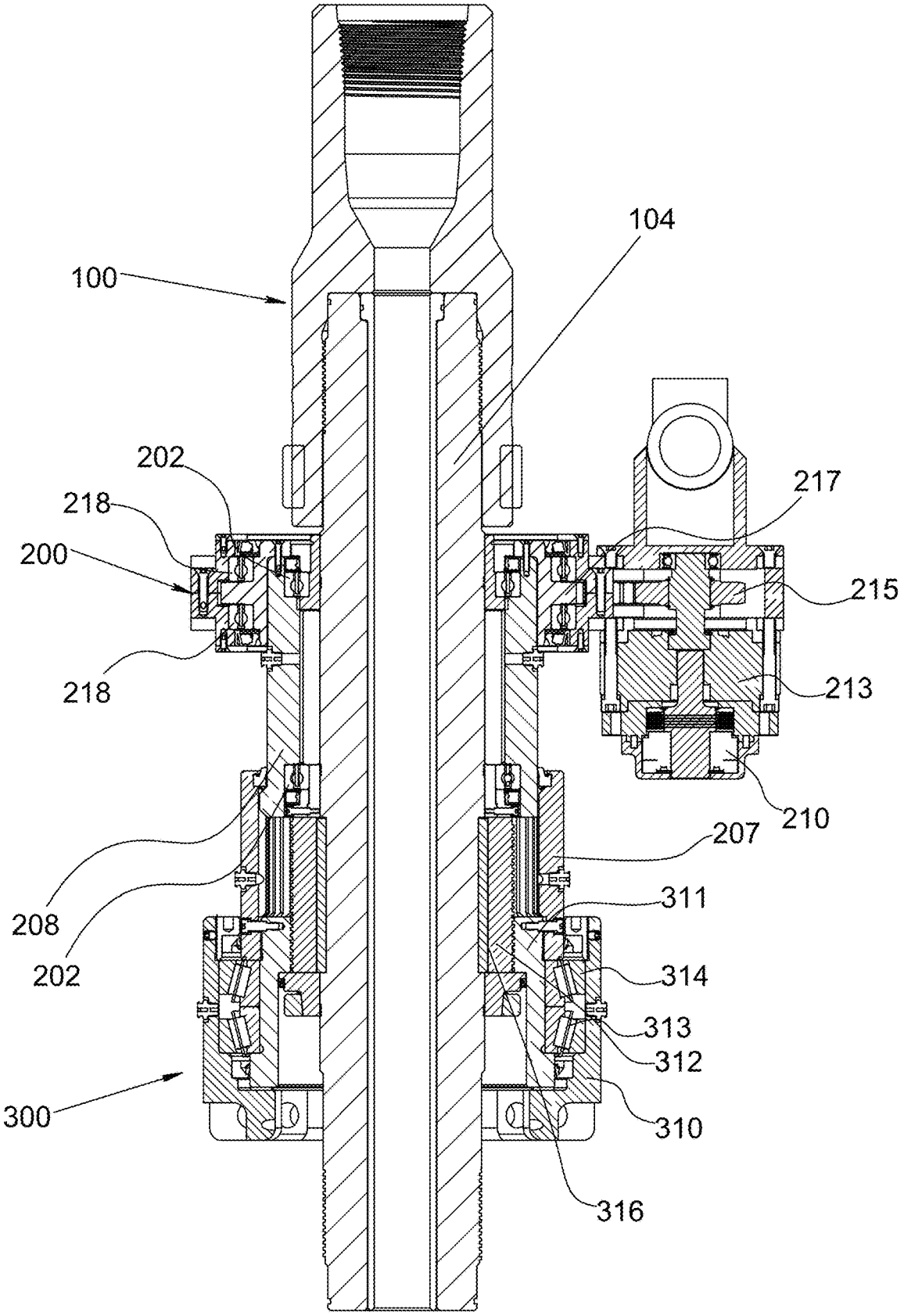
FIG. 4 depicts the actuator assembly of the present inventions in a set mode.

FIG. 4 shows a specific embodiment of the current inventions in the set mode. If the tool is in the released mode and the driller wants to set the tool on the tubular to make-up a joint, pressure must be applied to clutch assembly 210. The torsional force applied by the top drive is transmitted through the planetary gear drive 213, pinion gear 215 and ring gear 217 through to the ring gear sleeve 208 and further to female spline ring 207. The female spline 207 is rigidly attached to power screw female thread 311. Once the clutch is engaged the driller can now rotate the top drive clockwise to set the slips.

The top drive rotates clockwise which turns the power screw male thread 312 with the main tool shaft 104 through the torque key 316. The torque keys 316 allow the power screw male thread 312 to rotate at the set top drive torque to set the tool to the correct axial force. This torque is translated to axial force through the power screw female thread 311. The push plate 310 pushes the slips 303 through the main slip push bars 307 and secondary slip push bars 304 onto the pipe. This axial force pushing down on the slips 303 allows sufficient gripping force to resist rotational and axial load on the tubular.

Figure 5:
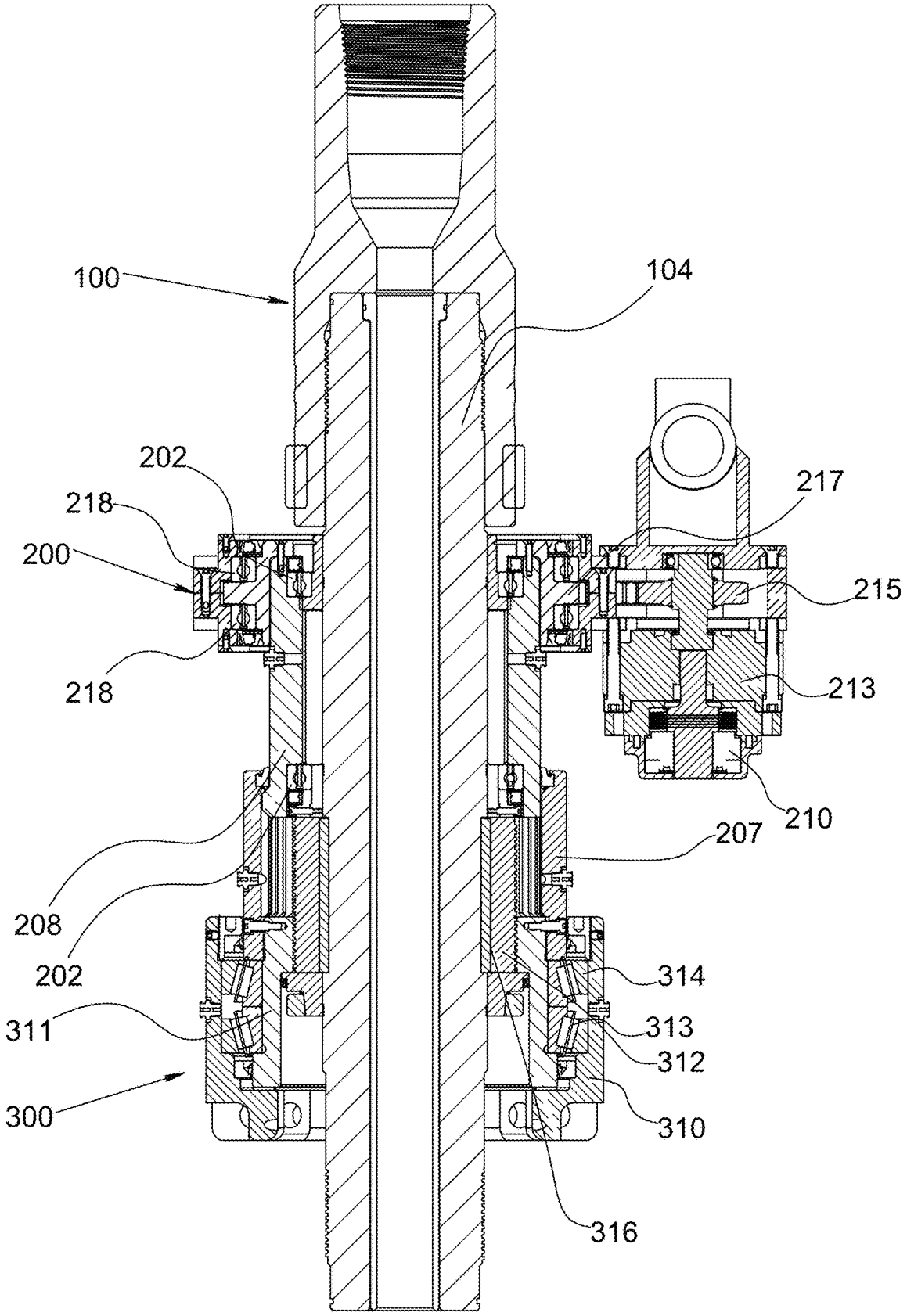
FIG. 5 depicts the actuator assembly of the present inventions in an operational mode.

FIG. 5 illustrates the tool being set on the tubular, ready for make-up. During make-up, clutch assembly 210 is released, the reaction torque is gone, and all the bearings are free to rotate. The tool transmits the top drive torque through to the tubular. When the tubular is made up, the top drive lifts the tubular and the slips on the rig floor are released. The tool can now be used as a running, drilling or reaming tool. The tool itself is not fluid actuated, but rather mechanically actuated, so there are no speed restrictions on rotating, except for the speed limitations of the top drive system of the rig.

An alternate method that can be used with the current inventions has a piston driven moveable hirth coupling transferring the reaction force onto the female nut of the power screw. This enables the movement of the slip assemblies to engage or dis-engage from the pipe. Once the engagement I disengagement is complete, the pressure to the actuator is relieved and the hirth coupling is disengaged by way of the spring assemblies pulling the hirth out of engagement automatically.

In this embodiment, the torque reaction of the female nut of the power screw is provided by the bails via the anti-rotation deck. This plate meets bails which act as a back stop for the reaction of the screw nut being screwed together. The anti-rotation deck is the preferred method, but not the only method. A bracket could also loosely grip the outside of the gripper box, or the top plate could be anchored to the gripper box with a bolt on bracket.

Figure 9:
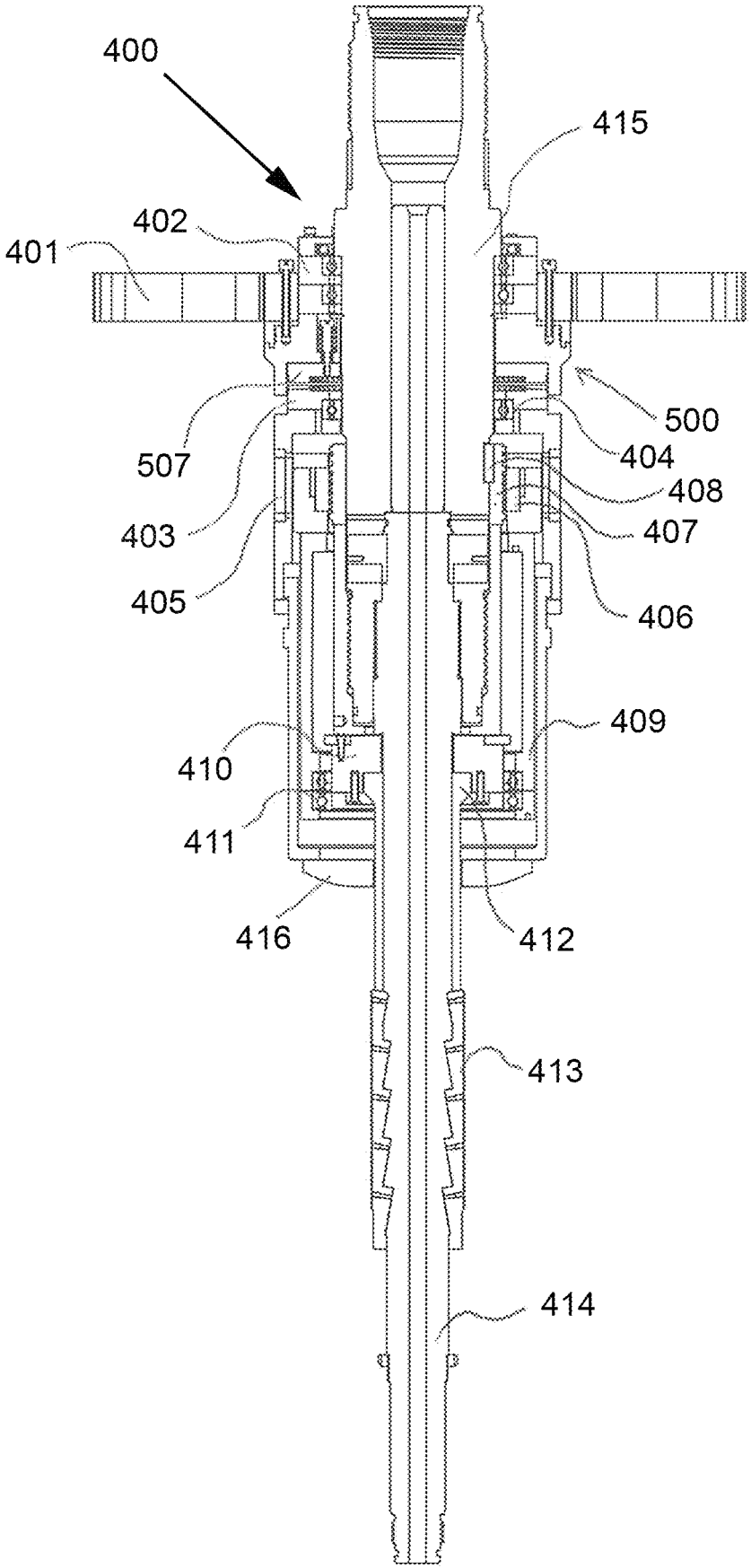
FIG. 9 depicts an actual piston assembly of the present inventions with the retract springs and torque pins.

FIG. 9 illustrates another embodiment of the fluid controlled mechanical casing running tool. This embodiment utilizes a movable hirth coupling half 507 and a lower fixed hirth coupling half 403.

With fluid power, the movable hirth half 507 is forced to mate with the lower fixed coupling half 403. This action makes the two halves come together and become torsionaly mated. This couples the anti-rotation deck 401 with the female power screw thread 406 which enables the deck to be held against the top drive's bails. This restricts tool rotation while the top drive is in use, rotating the power screw 407. With the female power screw thread 406 held, it traverses down the male power screw thread 407. Trunnion slots 405 keep the trunnions located (not shown) on the female nut from rotating. This converts rotational torque into axial force, moving the slip push plate carrier 409 which will set or release the slips depending on rotation (clockwise to set and counterclockwise to release).

Once the slips are set or released, the fluid actuated movable hirth is released, and the return springs 504 pull the movable hirth out of harm's way.

Figure 10:
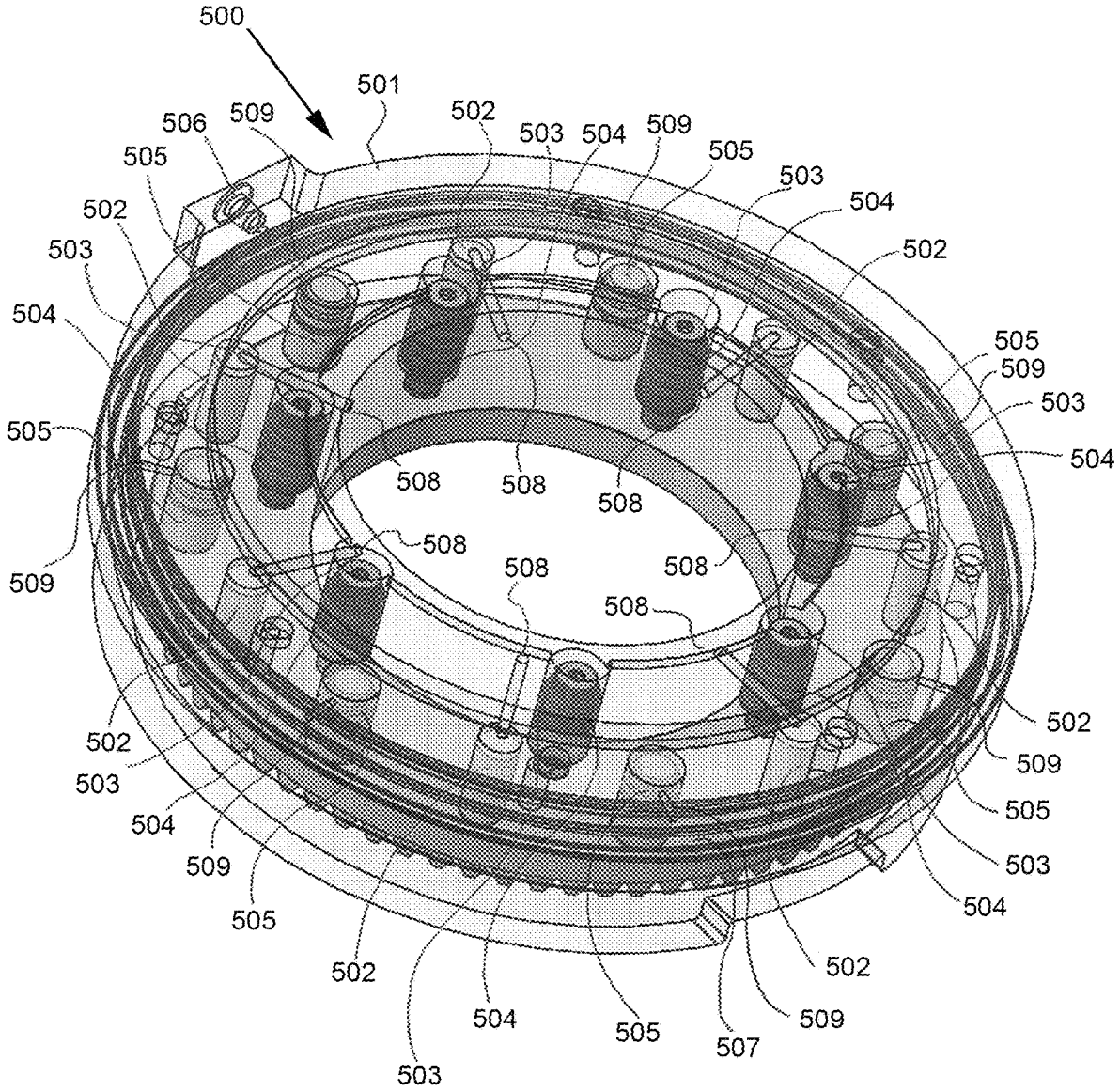
FIG. 10 depicts a fluid driven axial piston assembly of the present inventions.

FIG. 10 depicts a specific embodiment of a fluid actuator of the current inventions. The actuator assembly may consist of a plurality of fluid pistons 505 that provide the axial force to force the movable hirth coupling half 507 into engagement with the fixed hirth coupling half 403. The return springs 504 compress against the spring retaining bolt 503 when the fluid pistons 505 are energized. Once the actuator is de-energized, the compressed return springs 504 return to a relaxed state, pulling the movable hirth coupling half 507 out of engagement with the lower fixed hirth coupling half 403.

Torque resisted by the anti-rotation deck 401, is transmitted through the movable hirth coupling half 507 with the help of the torque pins 502. The torque pins 502 move in an axial plane with the movable hirth coupling half 507. The air breather ports 508 prevents build up of gas behind torque pins 502 when moving axially. The fluid pistons 505 receive the fluid through the fluid port 506 and fluid supply galley 509. The fluid port is sealed by the static seal ring 501 which in turn are sealed by the static O-ring seals 510.

The gripper box extend port, as well as any other usable ports on the rotary joint manifold (not shown), supplies the fluid axial piston assembly 500 with fluid. However other sources of fluid power mounted internally on the casing running tool or external to the casing running tool can be used to provide fluid to either method of operating the tool. A regenerative system using fluid from a reservoir or an external power unit are examples of such sources.

Figure 11:
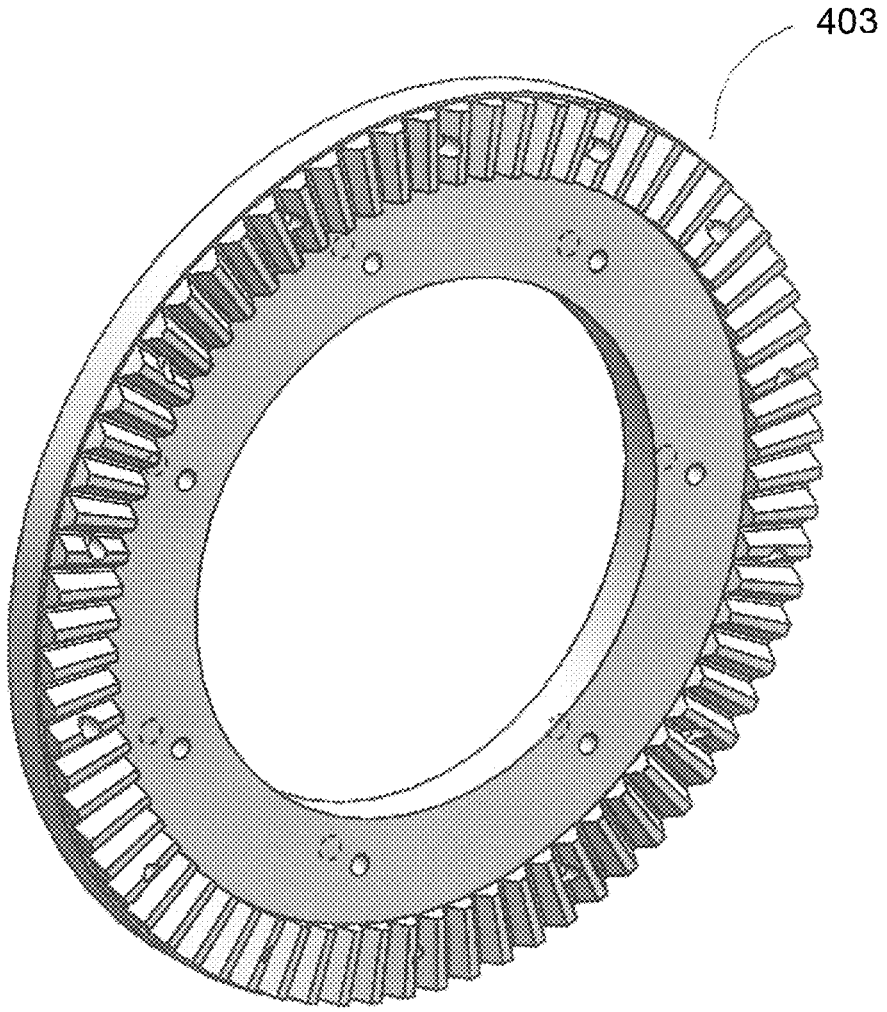
FIG. 11 depicts a fixed hirth plate assembly of the present inventions.

FIG. 11 illustrates the lower fixed hirth coupling half 403, a toothed flat spline plate that can engage a mating part and provide a torsional stiff coupling.

It is to be understood that the inventions disclosed herein are not limited to the exact details of construction, operation, exact materials or embodiments shown and described. Although specific embodiments of the inventions have been described, various modifications, alterations, alternative constructions, and equivalents are also encompassed within the scope of the inventions. Although the present inventions may have been described using a particular series of steps, it should be apparent to those skilled in the art that the scope of the present inventions is not limited to the described series of steps. The specification and drawings are, accordingly, to be regarded in an illustrative rather than a restrictive sense. It will be evident that additions, subtractions, deletions, and other modifications and changes may be made thereunto without departing from the broader spirit and scope of the inventions as set forth in the claims set forth below. Accordingly, the inventions are therefore to be limited only by the scope of the appended claims. None of the claim language should be interpreted pursuant to 35 U.S.C. 112(f) unless the word "means" is recited in any of the claim language, and then only with respect to any recited "means" limitation.

The invention claimed is:

1. An apparatus for transferring torque comprising:

a main tool body;

a main tool shaft disposed in the main tool body;

a power screw male thread disposed around the main tool shaft;

a power screw female thread movably engaged with the power screw male thread;

a friction member including an upper friction member connected to the main tool body and a lower friction member connected to the power screw female thread, the friction member having an engaged position in which the upper friction member is engaged with the lower friction member, the friction member having a disengaged position in which the upper friction member is disengaged from the lower friction member, the upper friction member being moved into the engaged position under force applied by fluid pressure, the upper friction member and the lower friction member cooperating to restrict rotation of the power screw female thread when the friction member is in its engaged position, the upper friction member and the lower friction member cooperating to permit rotation of the power screw female thread when the friction member is in its disengaged position; and a set of slips connected to the power screw female thread, the set of slips having a set position in which the set of slips are adapted to engage a tubular member, the set of slips having a released position in which the set of slips are adapted to disengage from the tubular member, the set of slips being moved into the set position when the friction member is in its engaged position, and the set of slips being moved into the released position when the friction member is in its engaged position.

2. The apparatus of claim 1, wherein the friction member is a hirth coupling, the upper friction member is a moveable half of the hirth coupling, and the lower friction member is a fixed half of the hirth coupling.

3. The apparatus of claim 2, further including a fluid actuator including a plurality of pistons adapted to force the moveable half of the hirth coupling into engagement with the fixed half of the hirth coupling when the pistons are actuated.

4. The apparatus of claim 3, wherein each of the plurality of pistons includes a corresponding return spring adapted to move the moveable half of the hirth coupling out of engagement with the fixed half of the hirth coupling when the plurality of pistons are not actuated.

5. The apparatus of claim 1, wherein the set of slips are moved away from the main tool shaft when the set of slips are in the released position, and the set of slips are moved toward the main tool shaft when the set of slips are in the set position.

6. The apparatus of claim 2, further including an anti-rotation deck attached to the main tool body, and the moveable half of the hirth coupling is connected to the anti-rotation deck.

7. An apparatus for transferring torque comprising:

a main tool body;

a main tool shaft disposed in the main tool body;

a power screw male thread disposed around the main tool shaft;

a power screw female thread movably engaged with the power screw male thread;

a set of two interlocking members adapted to be coupled together in a first position and decoupled from each other in a second position, the set of interlocking members including an upper interlocking member connected to the main tool body and a lower interlocking member connected to the power screw female thread, the upper interlocking member and the lower interlocking member being adapted for mating engagement when in the first position, and the upper interlocking member and the lower interlocking member being adapted for disengagement when in the second position; and a set of slips connected to the power screw female thread, the set of slips having a set position in which the set of slips are adapted to engage a tubular member, the set of slips having a released position in which the set of slips are adapted to disengage from the tubular member, the set of slips being moved into the set position when the upper interlocking member is engaged with the lower interlocking member, and the set of slips being moved into the released position when the upper interlocking member and the lower interlocking member are engaged with each other.

8. The apparatus of claim 7, wherein the set of two interlocking members is a hirth coupling, the upper interlocking member is a moveable half of the hirth coupling, and the lower interlocking member is a fixed half of the hirth coupling.

9. The apparatus of claim 8, further including a fluid actuator including a plurality of pistons adapted to force the moveable half of the hirth coupling into engagement with the fixed half of the hirth coupling when the pistons are actuated.

10. The apparatus of claim 9, wherein each of the plurality of pistons includes a corresponding return spring adapted to move the moveable half of the hirth coupling out of engagement with the fixed half of the hirth coupling when the plurality of pistons are not actuated.

11. The apparatus of claim 7, wherein the set of slips are moved away from the main tool shaft when the set of slips are in the released position, and the set of slips are moved toward the main tool shaft when the set of slips are in the set position.

12. The apparatus of claim 8, further including an anti-rotation deck attached to the main tool body, and the moveable half of the hirth coupling is connected to the anti-rotation deck.

13. The apparatus of claim 7, wherein the upper interlocking member is moved into engagement with the lower interlocking member under force applied by fluid pressure, the upper interlocking member and the lower interlocking member cooperating to restrict rotation of the power screw female thread when the upper interlocking member and the lower interlocking member are engaged with each other, and the upper interlocking member and the lower interlocking member cooperating to permit rotation of the power screw female thread when the upper interlocking member and the lower interlocking member are not engaged with each other.

14. The apparatus of claim 7, further including a slip push plate carrier adapted to axially set and release the set of slips in response to rotation of the female power screw thread.

15. The apparatus of claim 7, further including a plurality of torque pins adapted to transmit torque from an anti-rotation deck to the upper interlocking member.

16. The apparatus of claim 15, further including a plurality of air breather ports adapted to prevent gas build up behind the plurality of torque pins.

17. An apparatus for transferring torque comprising:

a main tool body;

a main tool shaft disposed in the main tool body;

a power screw male thread disposed around the main tool shaft;

a power screw female thread movably engaged with the power screw male thread;

a set of two interlocking members adapted to be coupled together in a first position and decoupled from each other in a second position, the set of interlocking members including an upper interlocking member connected to the main tool body and a lower interlocking member connected to the power screw female thread, the upper interlocking member and the lower interlocking member being adapted for mating engagement when in the first position, and the upper interlocking member and the lower interlocking member being adapted for disengagement when in the second position, the upper interlocking member being moved into engagement with the lower interlocking member under force applied by fluid pressure, the upper interlocking member and the lower interlocking member cooperating to restrict rotation of the power screw female thread when the upper interlocking member and the lower interlocking member are engaged with each other, and the upper interlocking member and the lower interlocking member cooperating to permit rotation of the power screw female thread when the upper interlocking member and the lower interlocking member are not engaged with each other; and a set of slips connected to the power screw female thread, the set of slips having a set position in which the set of slips are adapted to engage a tubular member, the set of slips having a released position in which the set of slips are adapted to disengage from the tubular member, the set of slips being moved into the set position when the upper interlocking member is engaged with the lower interlocking member, and the set of slips being moved into the released position when the upper interlocking member and the lower interlocking member are engaged with each other.

18. The apparatus of claim 17, wherein the set of two interlocking members is a hirth coupling, the upper interlocking member is a moveable half of the hirth coupling, and the lower interlocking member is a fixed half of the hirth coupling.

19. The apparatus of claim 18, further including a fluid actuator including a plurality of pistons adapted to force the moveable half of the hirth coupling into engagement with the fixed half of the hirth coupling when the pistons are actuated.

20. The apparatus of claim 19, wherein each of the plurality of pistons includes a corresponding return spring adapted to move the moveable half of the hirth coupling out of engagement with the fixed half of the hirth coupling when the plurality of pistons are not actuated.

21. The apparatus of claim 17, wherein the set of slips are moved away from the main tool shaft when the set of slips are in the released position, and the set of slips are moved toward the main tool shaft when the set of slips are in the set position.

22. The apparatus of claim 18, further including an anti-rotation deck attached to the main tool body, and the moveable half of the hirth coupling is connected to the anti-rotation deck.

23. The apparatus of claim 17, further including a slip push plate carrier adapted to axially set and release the set of slips in response to rotation of the female power screw thread.

24. The apparatus of claim 17, further including:

a plurality of torque pins adapted to transmit torque from an anti-rotation deck to the upper interlocking member; and a plurality of air breather ports adapted to prevent gas build up behind the plurality of torque pins.

* * * * *